US006123529A

United States Patent [19]

Kawano et al.

[11] Patent Number: 6,123,529

[45] Date of Patent: Sep. 26, 2000

[54] SCROLL COMPRESSOR

[75] Inventors: Isamu Kawano; Kazuaki Shiinoki; Natsuki Kawabata; Akira Suzuki, all of Shimizu; Shigeru Machida, Ibaraki-ken, all of Japan

[73] Assignee: Hitachi, Ltd., Tokyo, Japan

[21] Appl. No.: 09/024,563

[22] Filed: Feb. 17, 1998

[30] Foreign Application Priority Data

Mar. 4, 1997 [JP] Japan ..... 9-048731

[51] Int. Cl.[7] ..... F01C 1/02

[52] U.S. Cl. ..... 418/55.2; 418/55.1; 418/91; 418/142

[58] Field of Search ..... 418/55.2, 55.1, 418/91, 142

[56] References Cited

U.S. PATENT DOCUMENTS

| | | | |
|---|---|---|---|
| 1,376,291 | 4/1921 | Rolkerr | 418/142 |
| 2,248,029 | 7/1941 | Uzcudun | 418/142 |
| 3,261,335 | 7/1966 | Zimmerman | 418/142 |
| 3,720,096 | 3/1973 | Woodle . | |
| 3,884,599 | 5/1975 | Young | 418/55.1 |
| 3,924,977 | 12/1975 | Young | 418/55.1 |
| 3,986,799 | 10/1976 | McCullough | 418/55.1 |
| 3,994,633 | 11/1976 | Shaffer | 418/55.1 |
| 5,258,046 | 11/1993 | Haga et al. | 418/55.2 |
| 5,690,480 | 11/1997 | Suzuki et al. | 418/55.2 |
| 5,755,564 | 5/1998 | Machida et al. | 418/55.2 |
| 5,803,723 | 9/1998 | Suefuji et al. | 418/55.2 |
| 5,842,843 | 12/1998 | Haga | 418/55.2 |

FOREIGN PATENT DOCUMENTS

| | | | |
|---|---|---|---|
| 2148726 | 3/1973 | France | 418/142 |

*Primary Examiner*—Thomas Denion
*Assistant Examiner*—Thai-Ba Trieu
*Attorney, Agent, or Firm*—Antonelli, Terry, Stout & Kraus, LLP

[57] ABSTRACT

A double scroll compressor including an orbiting scroll having spiral wraps formed on both sides of an end plate includes two stationary scrolls, each having a wrap formed thereon to mesh with the corresponding one of the spirals to form a compressing flow passage. The power of a driver, such as a motor, is transmitted via pulleys to two crank shafts which are disposed to extend through the end plate of the orbiting scroll approximately symmetrically with respect to the end plate. The two crank shafts are synchronously rotationally driven by a timing belt disposed between the pulleys. While the crank shafts are making their rotary motions, the orbiting scroll makes its eccentric circular motion and a sucked gas is compressed between the orbiting scroll and the stationary scrolls. A multiplicity of cooling flow passages approximately perpendicular to a line which connects the axes of the crank shafts are formed to extend through the central portion of the end plate of the orbiting scroll. The heat generated in the meshed portion between the orbiting scroll and the stationary scrolls is carried to the outside of the compressor by cooling air which flows through the cooling through-passages.

10 Claims, 9 Drawing Sheets

SCROLL COMPRESSOR

BACKGROUND OF THE INVENTION

The present invention relates to a scroll compressor of the type used for an air compressor or a refrigerating or air-conditioning compressor, and, more specifically, the invention relates to a double scroll compressor having scroll wraps on both sides of an end plate.

To increase the capacity of a scroll compressor, a so called double scroll compressor has heretofore been proposed, which includes an orbiting scroll having spiral scrolls on both sides of an end plate and stationary scrolls each having a scroll was which is formed in a spiral shape to mesh with the corresponding one of the wraps of the orbiting scroll. In such a double scroll compressor, the amount of heat generated by a compressed gas remarkably increases as a result of an increase in capacity, as compared with ordinary single scroll compressors.

Incidentally, the art of effectively radiating the heat generated in a scroll wrap portion to improve the reliability of a conventional single scroll compressor is set forth in, for example, Japenese Patent Laid-Open No. 341384/1994. Regarding the above-described double scroll compressor, Japanese Patent Laid-Open No. 103151/1995 states that fins are provided on an orbiting scroll portion to cope with an increase in the amount of hear generated by an operating gas in a scroll wrap portion.

It is difficult to increase the capacity of a scroll compressor by increasing its scroll diameter or wrap height, because of certain limitations, such as the orbiting speed and the strength the scroll member. For this reason, a double scroll compressor has been proposed in which ordinary single scroll compressors are combined in a back-to-back fashion to realize an increase in capacity. For example, in a large scroll compressor whose driving motor output is in a 7.5-kW class, a sandwich structure is adopted in which scroll wraps are respectively disposed on both sides of the end plate of an orbiting scroll and the two scroll wraps of the orbiting scroll are meshed with the respective scroll wraps of two stationary scrolls. If the scroll compressor is constructed in this manner, the pressures of the operating gas which act in the thrust directions of a scroll wrap portion, i.e., thrust forces, act in directions opposite to each other and work to cancel themselves. This leads to the advantage that little consideration needs to be paid to the thrust forces which represent an important problem in the ordinary single scroll compressor. However, in the double scroll compressor, the orbiting scroll is sandwiched between the two stationary scrolls, so that the orbiting scroll is positioned inside the compressor and so it is difficult for the heat generated by the compressed gas to radiate from the orbiting scroll. Therefore, if heat radiating fins are simply provided on an orbiting scroll and a stationary scroll, as in the single scroll compressor disclosed in Japanese Patent Laid-Open No. 341384/1994, the structure for introducing the driving power required for the orbiting scroll becomes complicated and location in which to provide the fins are limited, and so heat radiation from the orbiting scroll becomes insufficient.

In the double scroll compressor set forth in Japanese Patent Laid-Open No. 103151/1995, although a multiplicity of cooling fins are arranged on the end plate of the orbiting scroll, no satisfactory consideration is given to ways of improving the reliability of the double scroll compressor by effectively cooling the central portion of the scroll wrap portion, which is heated to a maximum temperature in the scroll compressor. Furthermore, in the double scroll compressor set forth in Japanese Patent Laid-Open No. 103151/1995, since two auxiliary crank shafts are incorporated, in addition to a driving shaft, for the purpose of facilitating the driving of the orbiting scroll, it is difficult to form a cooling-medium flow passage which has a small fluid resistance.

SUMMARY OF THE INVENTION

The present invention is intended to solve the above-described problems of the prior art and a first object of the present invention is to effectively cool an orbiting scroll and improve the reliability of a double scroll compressor having wrap portions on both sides of an end plate.

A second object of the present invention is to facilitate the confirmation of gaps between wrap tip ends and wrap bottoms between an orbiting scroll and stationary scrolls in a double scroll compressor having wrap portions on both sides of an end plate.

A third object of the present invention is to provide a double scroll compressor of large capacity (whose driving motor output is 7.5 kW or more) in which the fluid resistance of a cooling medium is reduced to promote the exchange of heat between the cooling medium and an orbiting scroll.

A fourth object of the present invention is to prevent an orbiting scroll from rising to an abnormally high temperature owing to the heat generated in the meshed portion between wraps in a double scroll compressor having spiral wraps on both sides of the end plate of the orbiting scroll.

Other objects, advantages and effects of the present invention will become apparent from the following detailed description of the present invention.

To achieve the above-described objects, according to a first feature of the present invention, there is provided a scroll compressor comprising an orbiting scroll having spiral wraps on both sides of an end plate, first and second stationary scroll, each having a wrap which meshes with a corresponding one of the spirals wraps, the first and second stationary scrolls being respectively disposed on both sides of the orbiting scroll, a crank shaft for rotationally driving the orbiting scroll, a crank shaft for rotationally driving the orbiting scroll, an auxiliary crank shaft which rotates in synchronism with the crank shaft, and a driving mechanism for synchronously rotating the crank shaft and the auxiliary crank shaft, wherein the end plate of the orbiting scroll includes a plurality of through-passages which are approximately perpendicular to a straight line which connects an axis of the crank shaft and an axis of the auxiliary crank shaft.

To achieve the above-described objects, according to a second feature of the present invention, there is provided a scroll compressor comprising an orbiting scroll having spiral wraps on both sides of an end plate, first and second stationary scrolls, each having a wrap which meshes with a corresponding one of the spirals wraps, the first and second stationary scrolls being respectively disposed on both sides of the orbiting scroll, a crank shaft for rotationally driving the orbiting scroll, an auxiliary crank shaft which rotates in synchronism with the crank shaft, and a driving mechanism for synchronously rotating the crank shaft and the auxiliary crank shaft, wherein the end plate of the orbiting scroll includes a plurality of partitioned heat radiating paths for radiating heat generated in a meshed portion between the wraps of the orbiting scroll and the respective wraps of the first and second stationary scrolls.

To achieve the above-described objects, according to a third feature of the present invention, there is provided a scroll compressor comprising an orbiting scroll having spiral wraps on both sides of an end plate, first and second stationary scroll, each having a wrap which meshes with a corresponding one of the spirals wraps, the first and second stationary scrolls being respectively disposed on both sides of the orbiting scroll, a crank shaft for rotationally driving the orbiting scroll, an auxiliary crank shaft which rotates in synchronism with the crank shaft, and a driving mechanism for synchronously rotating the crank shaft and the auxiliary crank shaft, wherein the end plate of the orbiting scroll includes a plurality of partitioning walls which extend approximately over the whole width of the orbiting scroll and in a direction approximately perpendicular to a straight line which connects an axis of the crank shaft and an axis of the auxiliary crank shaft.

According to a fourth feature of the present invention, there is provided a scroll compressor comprising an orbiting scroll having spiral wraps on both sides of an end plate, first and second stationary scrolls, each having a wrap which meshes with a corresponding one of the spirals wraps, the first and second stationary scrolls being respectively disposed on both sides of the orbiting scroll, a crank shaft, and an auxiliary crank shaft which rotates in synchronism with the crank shaft for rotationally driving the orbiting scroll, and a driving mechanism for synchronously rotating the crank shaft and the auxiliary crank shaft, wherein flow passages for cooling air which cools the scroll compressor are formed in approximately the same direction in an outer surface side of at least one of the first and second stationary scrolls and in the end plate of the orbiting scroll.

To achieve the above-described objects, according to a fifth feature of the present invention, there is provided a scroll compressor comprising an orbiting scroll having spiral wraps on both sides of an end plate, first and second stationary scrolls, each having a wrap which meshes with a corresponding one of the spirals wraps, the first and second stationary scrolls being respectively disposed on both sides of the orbiting scroll, a crank shaft, and an auxiliary crank shaft, which rotates in synchronism with the crank shaft for rotationally driving the orbiting scroll, air sucked through a suction port formed in at least one of the first and second stationary scrolls being discharged through a discharge port formed in at least one of the first and second stationary scrolls, wherein the first and second stationary scrolls constitute a casing of the scroll compressor, and an inlet and an outlet for cooling air which cools the orbiting scroll are formed in the casing, the casing including filter means which communicates with the suction port and the inlet for the cooling air in common.

According to a sixth feature of the present invention, there is provided a scroll compressor comprising an orbiting scroll having spiral wraps on both sides of an end plate, first and second stationary scrolls, each having a wrap which meshes with a corresponding one of the wraps, the first and second stationary scrolls being respectively disposed on both sides of the orbiting scroll, a crank shaft and an auxiliary crank shaft, which rotates in synchronism with the crank shaft for rotationally driving the orbiting scroll, air sucked through a suction port formed in at least one of the first and second stationary scrolls being discharged through a discharge port formed in at least one of the first and second stationary scrolls, wherein an inlet and an outlet for cooling air which cools the orbiting scroll are formed in the first stationary scroll, the first stationary scroll including filter means which communicate with the suction port and the inlet for the cooling air in common.

According to a seventh feature of the present invention, there is provided a scroll compressor comprising an orbiting scroll having spiral wraps on both sides of an end plate, first and second stationary scroll, each having a wrap which meshes with a corresponding one of the wraps, the first and second stationary scrolls being respectively disposed on both sides of the orbiting scroll, a crank shaft and an auxiliary crank shaft, which rotates in synchronism with the crank shaft for rotationally driving the orbiting scroll, wherein an inlet and an outlet for cooling air which cools the orbiting scroll are formed in the first stationary scroll and a plurality of flow passages are formed in a direction which connects the inlet and the outlet, a plurality of heat radiating fins arranged in approximately the same direction as the direction of the plurality of flow passages being provided on an outer surface portion of at least one of the first and second stationary scrolls.

Preferably, a groove is formed in a widthwise end of at least one of the wrap of the orbiting scroll and the wraps of the first and second stationary scrolls, and a tip seal is fitted in the groove. In addition, preferably, at least one of the first and second stationary scrolls having the respective wraps has a dust wrap which surrounds a peripheral portion of the wrap, and a groove is formed in a widthwise end of the dust wrap and a dust seal is fitted in the groove. Furthermore, preferably, a communication port for placing a scroll wrap portion and a suction port for sucking an operating gas, formed in the stationary scroll having the dust wrap, in communication with each other is formed in the dust wrap.

According to an eighth feature of the present invention, there is provided a scroll compressor comprising an orbiting scroll having spiral wraps on both sides of an end plate, first and second stationary scrolls, each having a wrap which meshes with a corresponding one of the spirals warps, the first and second stationary scrolls being respectively disposed on both sides of the orbiting scroll, a crank shaft and an auxiliary crank shaft, which rotates in synchronism with the crank shaft for rotationally driving the orbiting scroll, air sucked through a suction port formed in at least one of the first and second stationary scrolls being discharged through a discharge port formed in at least one of the first and second stationary scrolls, wherein the first stationary scroll has an inlet and an outlet for cooling air which cools the orbiting scroll, and at least one of the first and second stationary scrolls having respective wraps has a dust wrap which surrounds a peripheral portion of the wrap, a gap formed between the dust wrap and the end plate of the orbiting scroll being capable of being measured through the inlet or the outlet for the cooling air.

According to a ninth feature of the present invention, there is provided a scroll compressor comprising an orbiting scroll having spiral wraps on both sides on an end plate, first and second stationary scrolls, each having a wrap which meshes with a corresponding one of the spirals wraps, the first and second stationary scrolls being respectively disposed on both sides of the orbiting scroll, a crank shaft and an auxiliary crank shaft, which rotates in synchronism with the crank shaft for rotationally driving the orbiting scroll, air sucked through a suction port formed in at least one of the first and second stationary scrolls being discharged through a discharge port formed in at least one of the first and second stationary scrolls, wherein the first stationary scroll has an inlet and an outlet for cooling air which cools the orbiting scroll, and the orbiting scroll having the wraps has dust wraps each of which surrounds a peripheral portion of a corresponding one of the wraps, a widthwise gap formed between the dust wrap and each of the first and second stationary scrolls being capable of being measured through the inlet or the outlet for the cooling air.

DETAILED DESCRIPTION OF THE INVENTION

Figure 1:
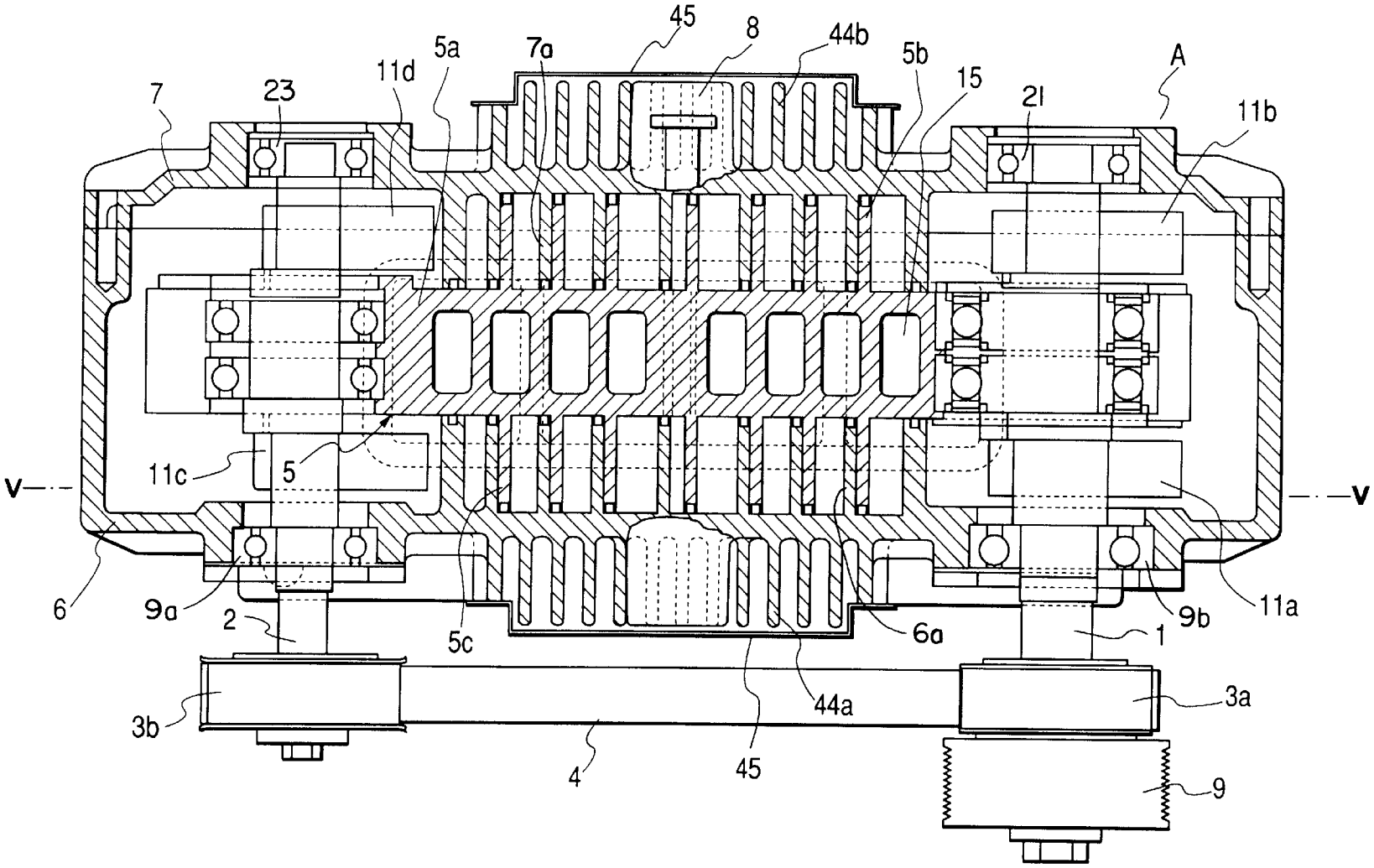
FIG. 1 is a cross-sectional view of one embodiment of a double scroll compressor according to the present invention.
Figure 2:
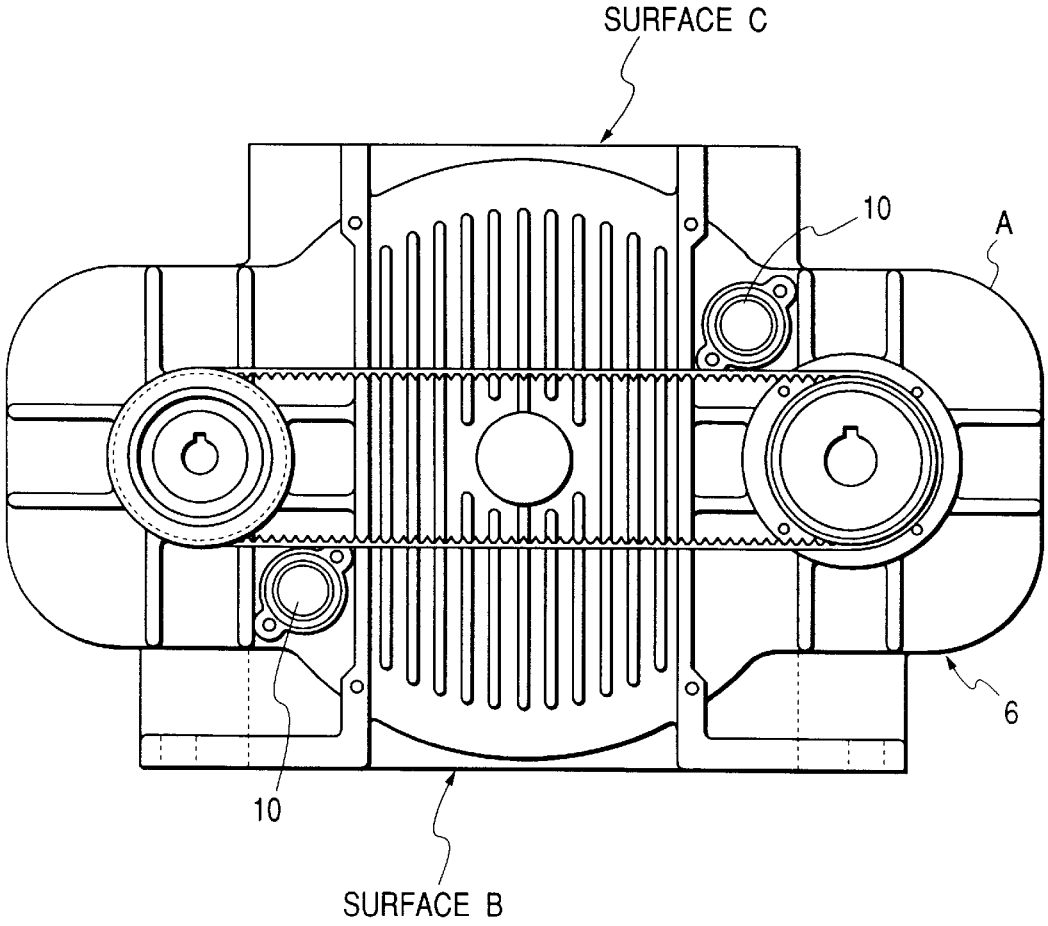
FIG. 2 is a front view of the embodiment of the double scroll compressor shown in FIG. 1.
Figure 3:
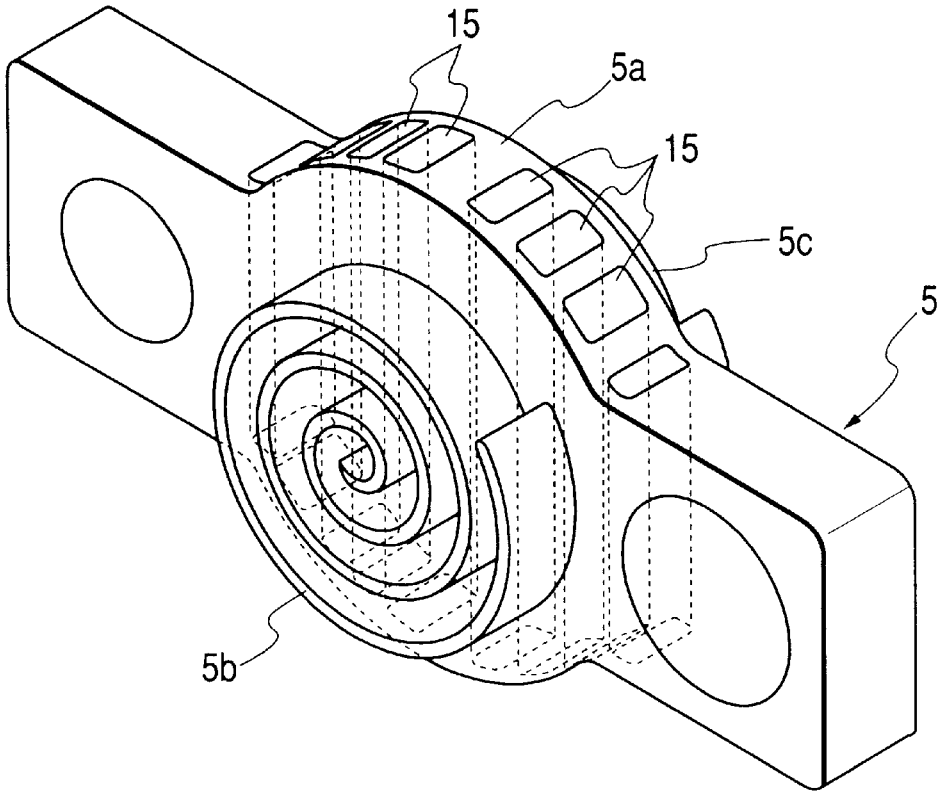
FIG. 3 is a perspective view of one embodiment of an orbiting scroll having cooling through-holes which is used in the double scroll compressor according to the present invention.
Figure 4:
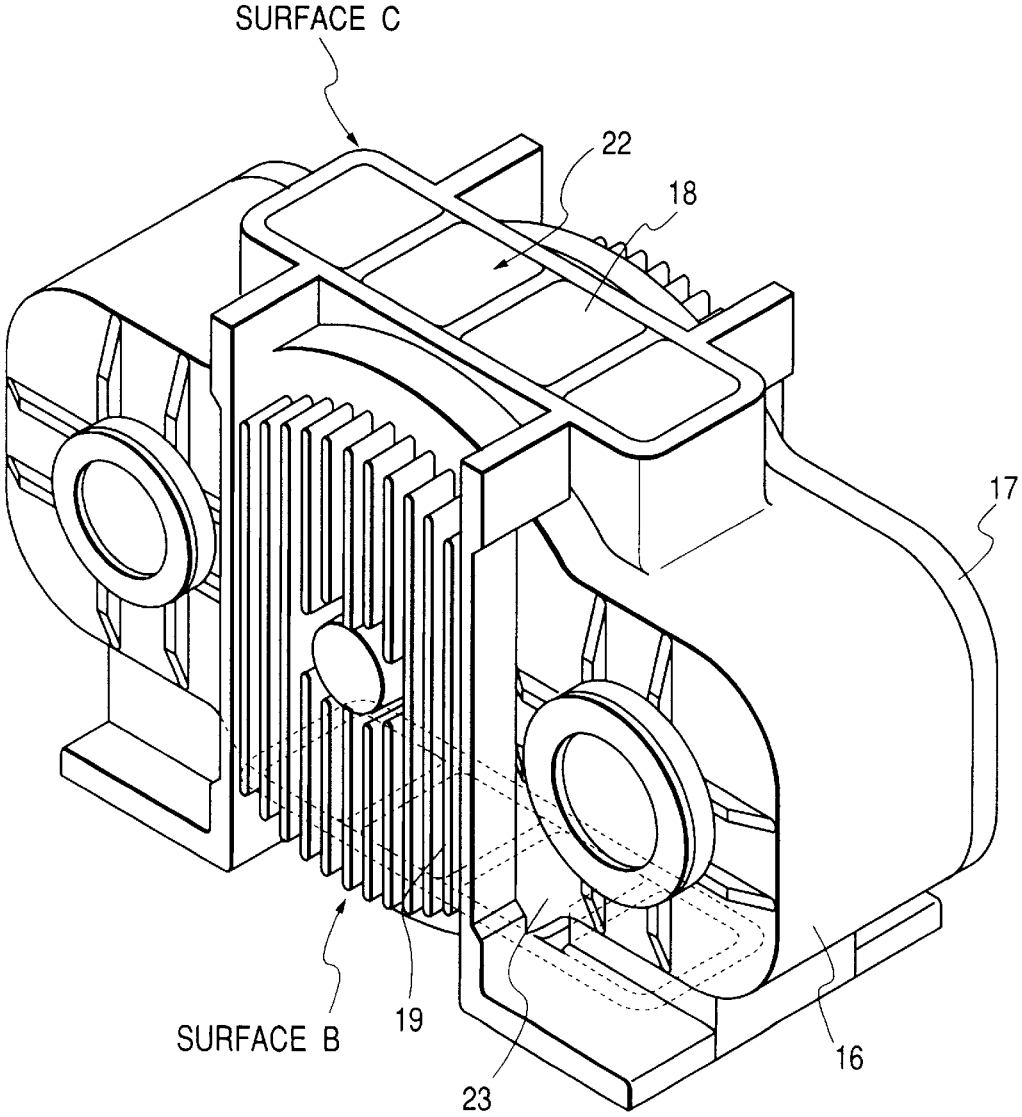
FIG. 4 is a perspective view of one embodiment of a stationary scroll used in the double scroll compressor according to the present invention.

Several embodiments of the present invention will be described below with reference to the accompanying drawings. FIGS. 1 to 4 show a first embodiment, wherein FIG. 1 is a cross-sectional view, FIG. 2 is a front view, FIG. 3 is a perspective view of an orbiting scroll used in the first embodiment, and FIG. 4 is a perspective view of the overall configuration of the first embodiment.

Power is transmitted from a motor (not shown) to a scroll compressor A via a timing pulley 9 and a belt (not shown) passing around the periphery of the timing pulley 9. The timing pulley 9 and a timing pulley 3*a* are fixed to one end of a crank shaft 1. The crank shaft 1 is fitted in a through-hole provided in the vicinity of one end of an orbiting scroll 5, via a groove ball bearing 9*b*.

The orbiting scroll 5 includes an end plate 5*a* and spiral scroll wraps 5*b* and 5*c* formed on both sides of the end plate 5*a*, which are respectively represented at the top and bottom sides of the end plate 5*a* in FIG. 1. A wrap 7*a* of a stationary scroll 7 meshes with the wrap 5*b* of the orbiting scroll 5 and wrap 6*a* of a stationary scroll 6 meshes with the wrap 5*c* of the orbiting scroll 5, that is, the stationary scrolls 6 and 7 are disposed on both sides of the orbiting scroll 5 in such a manner as to sandwich the orbiting scroll 5. An auxiliary crank shaft through-hole is formed in the vicinity of the end of the orbiting scroll 5 opposite to the crank shaft through-hole, and an auxiliary crank shaft 2 is rotatably supported by a shielded type of a groove ball bearing 9*a* held in the auxiliary crank shaft through-hole. In addition, the other ends of the crank shaft 1 and the auxiliary crank shaft 2 are respectively rotatably supported by ball bearings 21 and 23 held in the stationary scroll 7. A timing pulley 3*b* is fixed to the end portion of the auxiliary crank shaft 2 opposite to the end portion supported by the ball bearing 23, and a timing belt 4 is disposed between the timing pulley 3*b* and the timing pulley 3*a*. Accordingly, power from a driver is synchronously transmitted to the crank shaft 1 and the auxiliary crank shaft 2.

The crank shaft 1 and the auxiliary crank shaft 2 have structures which are eccentric in the respective through-holes of the orbiting scroll 5 so that the orbiting scroll 5 can orbit without rotating on its axis. Since both crank shafts 1 and 2 are eccentric, the orbiting scroll 5 can make an eccentric rotary (orbiting) motion, but the problem that excessive centrifugal force acts on both crank shafts 1 and 2 occurs. To cancel or reduce this centrifugal force, balance weights 11*a* and 11*b* and balance weights 11*c* and 11*d* are secured to the crank shafts 1 and 2, respectively.

In the first embodiment of the present invention constructed in this manner, the crank shafts 1 and 2 synchronously rotate to cause the orbiting scroll 5 to make an orbiting motion. During this time, gas sucked into the body of the scroll compressor A through a suction port formed in the stationary scroll 6 of the scroll compressor A on a pulley side thereof enters a crescent-shaped compression chamber formed between the wrap 5*b* of the orbiting scroll 5 and the wrap 7*a* of the stationary scroll 7 and between the wrap 5*c* of the orbiting scroll 5 and the wrap 6*a* of the stationary scroll 6, and the gas is compressed as the compression chamber is gradually decreased in volume. The gas compressed to a predetermined pressure is discharged to a demand side through a discharge port formed in a central portion of the scroll compressor A. As the pressure of the sucked gas rises, the temperature of the gas also rises; for example, gas sucked at a normal temperature (approximately 30° C.) rises to a temperature of 200–250° C. In the orbiting scroll 5, an aluminum ally is often used in view of the workability and ease of assembly and a reduction in eccentricity of weight, however the characteristics of an aluminum ally are in general degraded at a working temperature over 180° C. Accordingly, it is necessary to maintain a temperature of 180° C. or less even near the outlet portion of the orbiting scroll 5, which is heated to a maximum temperature.

For this reason, in the first embodiment, the end plate 5*a* of the orbiting scroll 5 is made thicker than in an ordinary single type of scroll compressor and a plurality of flow passages are formed in the end plate 5*a* to extend therethrough in the widthwise direction of the orbiting scroll 5. The directions of the flow passages are selected to be perpendicular to a line which connects the axes of the two crank shafts 1 and 2. A plurality of cooling fins 44*a* and 44*b*, which are arranged in parallel with each other, are provided on the outer surface sides of the respective stationary scrolls 6 and 7, which are disposed on both sides of the orbiting scroll 5. The cooling fins 44*a* and 44*b* extend in a direction approximately perpendicular to the line which connects the axes of the crank shafts 1 and 2, that is, from a side B toward a side C as viewed in FIG. 2. Both cooling fins 44*a* and 44*b* are covered with covers 45 at their widthwise opposite ends (their vertical opposite ends as viewed in FIG. 1) so that flow passages for cooling air which flows between the cooling fins are formed.

In a scroll compressor, since gas is sucked on its peripheral side and, after being compressed, is discharged from its central portion, a temperature rise is more remarkable in the central portion than in the peripheral portion. In addition, the central portion, which is distant from external cooling air, is difficult to cool. Particularly in a double scroll type of compressor, to cope with an increase in the required driving power, a plurality of crank shafts must be used, unlike a single type of scroll compressor which uses one crank shaft, and, so its cooling-allowable structure is greatly affected by the layout of the crank shafts.

In the first embodiment, a cooling fan (not shown) is used to introduce external air into a plurality of approximately parallel cooling flow passages formed between the two crank shafts. The crank shafts are arranged at locations offset from the central portion of the scroll compressor, and a driving mechanism and a supporting mechanism for the crank shafts are also offset from the central portion. Accordingly, an element which hinders cooling is eliminated from the central portion and each of the flow passages can be formed into a simple shape which extends straightforwardly through the end plate 5*a* of the orbiting scroll 5, and it is also possible to cool the central portions of the scrolls, which have been difficult to cool. In this construction, as compared with a case where cooling is not effected, the discharge temperature can be lowered by 40° C. or more, whereby the life of the scroll member, such as a tip seal, can be extended. As shown in FIG. 4, flow passages, the number of which is smaller than that of the flow passages formed in the end plate 5*a* and which extend from a suction port 18 to an exhaust port 19 which face the plurality of flow passages formed in the end plate 5*a,* are formed in the top and bottom sides of the stationary scroll 6. Accordingly, in the first embodiment, cooling flow passages 15 provided in the end plate 5*a* of the orbiting scroll 5, suction flow passages 22 and exhaust flow passages 23 provided in the stationary scroll 6 are disposed to be connected to each other, whereby cooling air which has risen in temperature after cooling the orbiting scroll 5 hardly flows toward the bearing portions of the crank shafts, and, therefore, a temperature rise in the bearings or the like is prevented and the life of the bearings and the reliability of the scroll compressor are improved.

Although in the above-described embodiment the suction port 18 and the exhaust port 19 are provided only in the stationary scroll 6, such suction and exhaust ports may also be provided by combining the stationary scroll 6 and the stationary scroll 7. In this case, although a member such as a seal, is needed for combining surface, the casting molds for the stationary scrolls are simplified. In addition, in the end plate 5*a,* which is formed in a thick shape, it is easier to mount the bearings 9*a* and 9*b* to the respective crank shafts 1 and 2.

Figure 5:
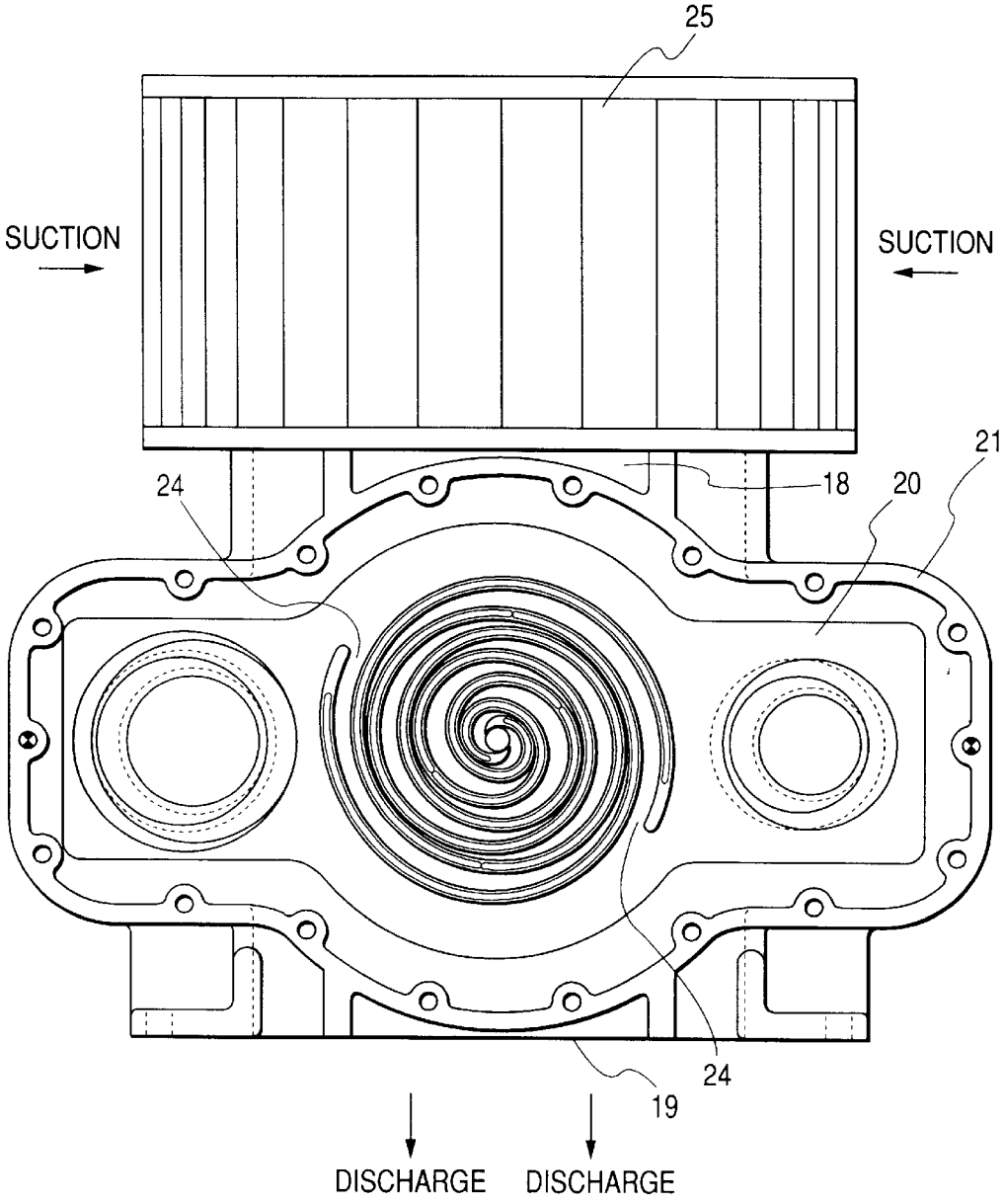
FIG. 5 is a cross-sectional view taken along line V—V of FIG. 1.

FIG. 5 shows a second embodiment of the scroll compressor according to the present invention, with the scroll portion shown in cross section. Cooling flow passages similar to those shown in FIG. 3 are formed in an end plate of an orbiting scroll 20. The suction port 18 and the exhaust port 19 are formed in a stationary scroll 21. A filter 25 for air filtration is disposed upstream of the suction port 18, and compressing air and cooling air passes through the filter 25. Air from which dust or the like has been removed by the filter 25 flows into both the cooling flow passages of the orbiting scroll 20 and a compression chamber 24 formed by a stationary scroll wrap and an orbiting scroll wrap. At this time, the amount of air which flows into the compression chamber 24 is automatically determined because the suction side of the compression chamber 24 is set to a negative pressure by the rotation of the orbiting scroll 20. The air which has passed through the cooling flow passages formed in the end plate of the orbiting scroll 20 is discharged through the exhaust port 19, while the air which has passed into the compression chamber 24 of the scroll compressor is compressed to high temperature by the rotation of the crank shafts and then flows to a demand side from a discharge port formed in the central portion of the scroll compressor. In the second embodiment, since cooling air flow passages and compressed gas flow passages communicate with each other at a filter portion, the flow passage structure of the scroll compressor becomes simple, and contaminants, such as dust are prevented from entering the inside of the scroll compressor, whereby the reliability of the scroll compressor is improved.

Figure 6:
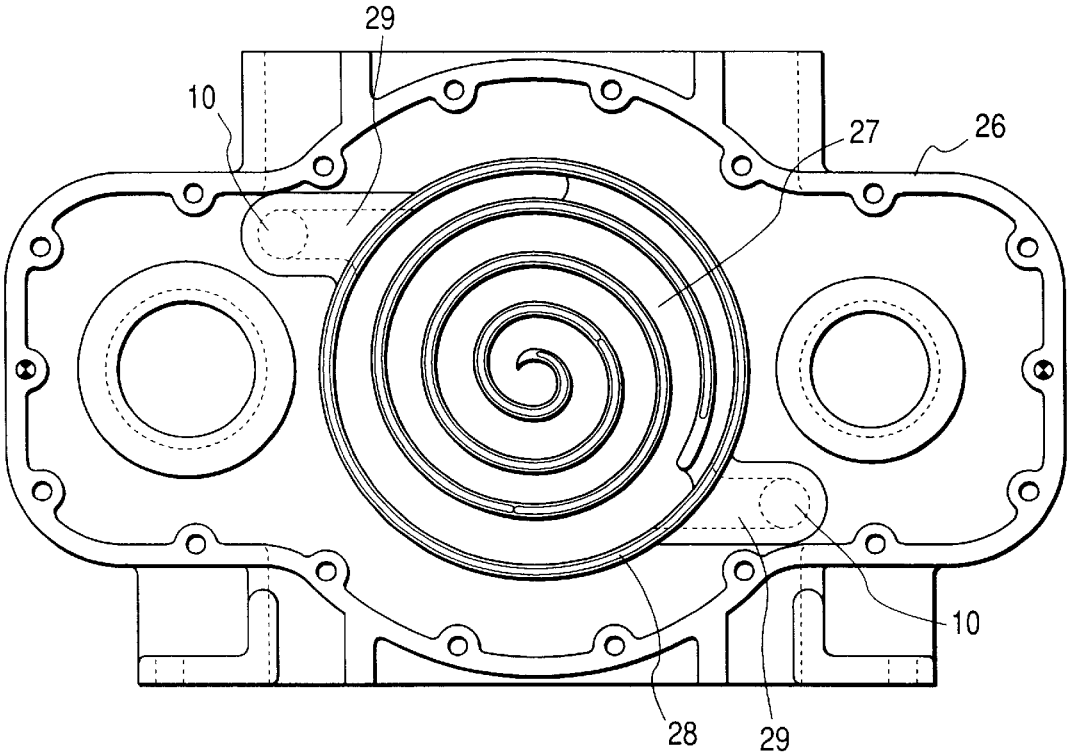
FIG. 6 is a front view of one embodiment of a double scroll compressor according to the present invention.
Figure 7:
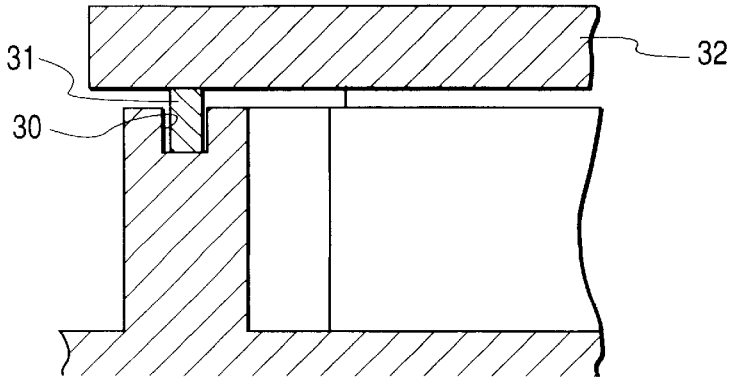
FIG. 7 is a detailed cross-sectional view of a dust wrap used in the stationary scroll shown in FIG. 6.
Figure 8:
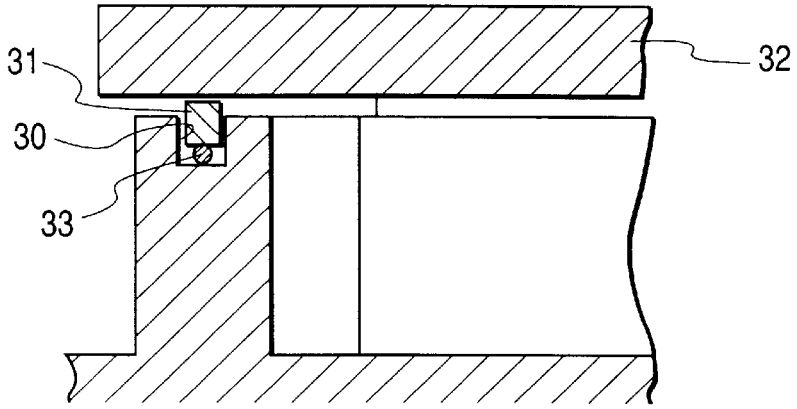
FIG. 8 is a detailed cross-section view of a modification of the dust wrap shown in FIG. 7.
Figure 9:
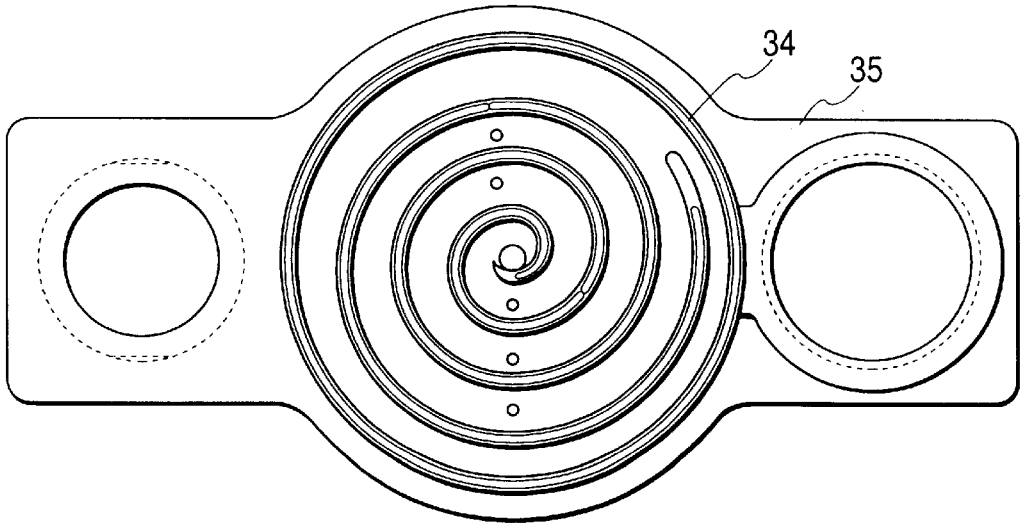
FIG. 9 is a front view of one embodiment of an orbiting scroll having a dust wrap, which is used in the double scroll compressor according to the present invention.
Figure 10:
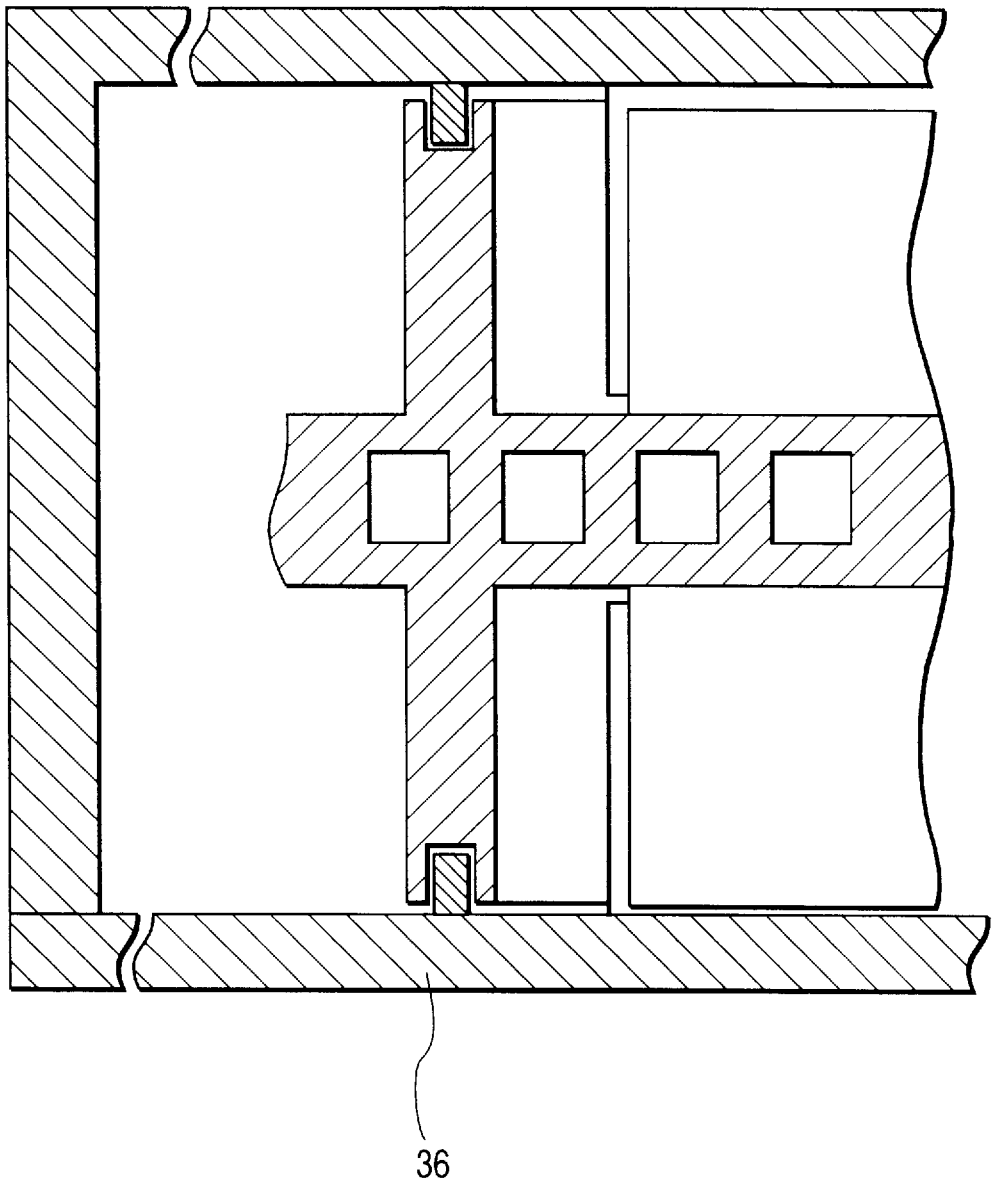
FIG. 10 is a detailed cross-sectional view of the dust wrap shown in FIG. 9.

A third embodiment of the present invention will be described with reference to FIGS. 6 to 10. FIG. 6 is a front view of a stationary scroll, FIGS. 7 and 8 are detailed cross-sectional views of a dust wrap portion, and FIGS. 9 and 10 are detailed views of the orbiting scroll on which a dust wrap is provided, FIG. 9 being a front view of the orbiting scroll and FIG. 10 being a detailed cross-sectional view of the dust wrap portion. A dust wrap 28 is formed to surround a scroll wrap 27 of a stationary scroll 26. The dust wrap 28 is approximately cylindrical, and the height of the dust wrap 28 in the widthwise direction thereof, that is, in the direction from the reverse side to the obverse side of the sheet of FIG. 6, is approximately equal to the height of the stationary scroll wrap 27. When the scroll compressor is assembled, a small gap is formed between the dust wrap 28 and an end plate of the orbiting scroll having a wrap which meshes with the wrap 27 of the stationary scroll 26. Compressing air suction ports are formed around the dust wrap 28 on the side of the inner wall of the stationary scroll 26 so that compression air suction passages 29, which are respectively formed in the cavity and communicate with the suction ports 10 formed in the outer surface of the stationary scroll 26, are placed in communication with a compression chamber formed inside the dust wrap 28. A seal groove 30, such as that shown in FIG. 7 of FIG. 8, is provided in the widthwise tip end of the dust wrap 28. A dust seal 31 is fitted in the seal groove 30. The dust seal 31 is dimensioned so that the dust wrap 28 is in contact with or has a slight gap with respect to an end plate 32 of the orbiting scroll. The material of the dust seal 31 is desirably selected from engineering plastics, such as tetrafluoroethylene resin, particularly preferably, materials containing good lubricants. This dust seal 31 acts to prevent cooling air which flows in through the suction ports 10 from flowing into the compression chamber formed by the scroll wrap 27. As shown in FIG. 8, an elastic element 33, such as an O-ring, may be disposed between the dust seal 31 and the bottom of the seal groove 30 to actively maintain contact by the dust seal 31 against the end plate 32 of the orbiting scroll. In this case, sealing characteristics are improved to a further extend. Incidentally, as shown in FIGS. 9 and 10, a dust wrap 34 may also be provided on an orbiting scroll 35. In this case, as well as in FIGS. 7 and 8, a slight gap may be provided between the dust wrap 34 and the inner wall surface of a stationary scroll, or a seal material having elasticity may be used to keep the dust wrap 34 in contact with the inner wall surface of the stationary scroll. If such a slight gap is provided, leakage of cooling air may occur, but the power required to drive the scroll compressor can be decreased because there is no contact resistance. On the other hand, if the dust wrap 34 is kept in contact with the inner wall surface of the stationary scroll, the required power increases, but the reliability of the scroll compressor is improved because no cooling air enters the compression chamber.

Furthermore, in the scroll compressor provided with the above-described dust wraps 28 and 34, the position of the suction port 18 is determined so that the thrust gap between the orbiting scroll and the stationary scroll can be confirmed in a scroll wrap portion. Specifically, as shown in FIG. 4, the suction port 18 and the cooling flow passages 22 are formed approximately straightforwardly so that the internal structure of the scroll compressor can be viewed or measured. Accordingly, the gap between the dust wraps and the end plate or between the dust wraps and the inner wall surface can be confirmed by visual inspection or by measurement.

A fourth embodiment of the present invention will be described with reference to FIGS. 11 and 12.

Figure 11:
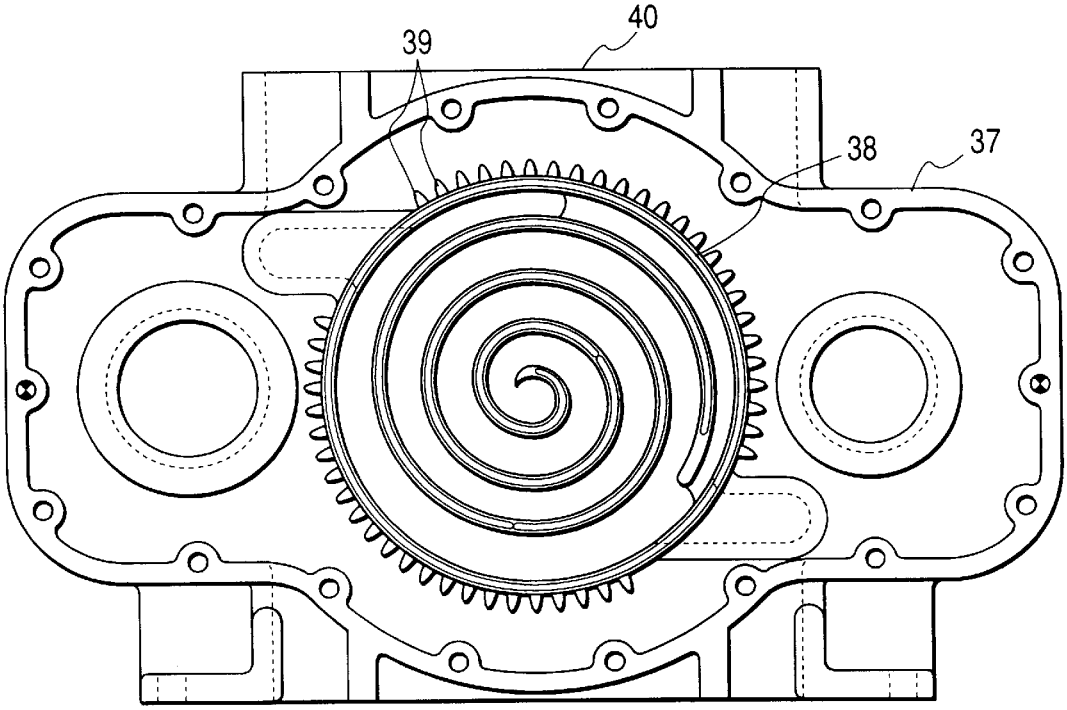
FIG. 11 is a front view of one embodiment of a stationary scroll having a dust wrap with cooling fins, which is used in the double scroll compressor according to the present invention.
Figure 12:
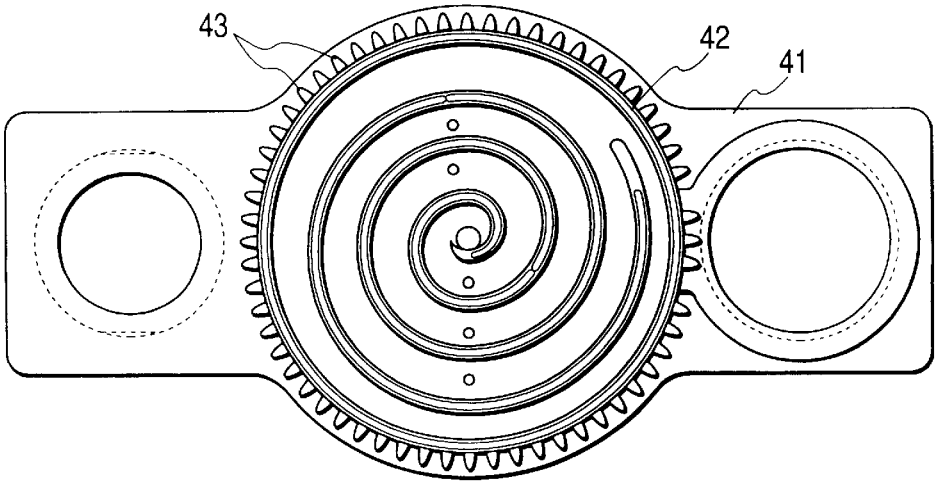
FIG. 12 is a front view of one embodiment of an orbiting scroll having a dust wrap with cooling fins, which is used in the double scroll compressor according to the present invention.

FIG. 11 is a front view of a stationary scroll, and FIG. 12 is a front view of an orbiting scroll. The example shown in FIG. 11 differs from any of the above-described embodiments in that cooling fins 39 are provided on a dust wrap 38 formed on a stationary scroll 37. In this construction, part of the air sucked through a suction port 40 passes through cooling flow passages formed in the end plate of an orbiting scroll and that part of the air can cool the dust wrap 38 of the stationary scroll. Accordingly, the cooling efficiency of the scroll compressor is improved, and, hence, the reliability and performance of the scroll compressor are improved.

FIG. 12 shows an example in which a dust wrap 42 is formed on an orbiting scroll and cooling fins 43 are provided on the dust wrap 42. Part of air sucked through a suction port passes through cooling flow passages formed in the end plate of an orbiting scroll 41 and that part of the air can cool the dust wrap 42 of the orbiting scroll 41. In this case as well, similar to the above-described example, it is possible to achieve the effect of improving the operability and the cooling efficiency of the scroll compressor, and, hence, the reliability and performance of the scroll compressor are also improved.

In the above description of each of the embodiments, reference has been made to a case where a dust wrap is formed integrally with a stationary scroll or an orbiting scroll, but, needless to say, such a dust wrap may be formed separately. In addition, heat radiating fins may be formed integrally with or separately from the dust wrap. Furthermore, flow passages formed in the end plate of the orbiting scroll or the stationary scroll may have a rectangular cross-sectional shape, a circular cross-sectional shape or the like. In addition, a large flow passage may be formed in such a manner as to be partitioned by wall surfaces. Furthermore, the suction port for external cooling air and the exhaust port may be reversed in their vertical positions, and the crank shafts of the scroll compressor may be arranged in a vertical direction. Furthermore, the crank shaft and the auxiliary crank shaft may be positioned in such a manner that either of them lies above the other. In other words, the present invention is intended to maximize the efficiency of carrying heat from an orbiting scroll in a double scroll type compressor and to improve at least one of the reliability and performance of the scroll compressor. Therefore, the present invention is not limited to any of the above-described embodiments, and the scope of the present invention is defined by the scope of the appended claims and all modifications included within the spirit and scope of the claims are included in the present invention.

In accordance with the present invention, in a double scroll type compressor including an orbiting scroll having wraps on both sides of an end plate, cooling flow passages are formed to extend through the end plate positioned in a central portion of the orbiting scroll so that the orbiting scroll can be effectively cooled. Accordingly, it is possible to improve the performance and reliability of the scroll compressor.

What is claimed is:

1. A scroll compressor comprising:

an orbiting scroll having an end plate holding opposed major surfaces and having spiral wraps extending from the opposed major surfaces on both sides of an end plate;

first and second stationary scrolls, each having a wrap which meshes with a corresponding one of the spiral wraps, said first and second stationary scrolls being respectively disposed on both sides of said orbiting scroll;

a crank shaft and an auxiliary crank shaft, which rotates in synchronism with said crank shaft, for rotationally driving said orbiting scroll; and a driving mechanism for synchronously rotating said crank shaft and said auxiliary crank shaft;

wherein the end plate of said orbiting scroll includes a plurality of through-passages between and substantially parallel to the opposed major surfaces; and wherein at least on of said first and second stationary scrolls has a cooling air inlet and a cooling air outlet forming at least one cooling path with said through-passages in a substantially straight line through said inlet, said through-passages and said outlet.

2. A scroll compressor according to claim 1, further comprising a suction port formed in at least either one of said first and second stationary scrolls and a discharge port formed in at least one of said first and second stationary scrolls, wherein said first and second stationary scrolls constitute a casing of said scroll compressor, and said cooling air inlet and said cooling air outlet are formed in said casing, said casing including filter means which communicates with the suction port and said cooling air inlet in common.

3. A scroll compressor according to claim 1, further comprising a suction port formed in at least one of said first and second stationary scrolls and a discharge port formed in at least one of said first and second stationary scrolls, wherein said cooling air inlet and outlet are formed in said first stationary scroll, said first stationary scroll including filter means which communicate with the suction port and said inlet in common.

4. A scroll compressor according to claim 1, further comprising a plurality of heat radiating fins arranged in approximately the same direction as the direction of said plurality of flow passages provided on an outer surface portion of at least one of said first and second stationary scrolls.

5. A scroll compressor according to claim 1, wherein a groove is formed in a widthwise end of at least any one of the wrap of said orbiting scroll and the wraps of said first and second stationary scrolls, and a tip seal is fitted in the groove.

6. A scroll compressor according to claim 5, wherein at least one of said first and second stationary scrolls having the respective wraps has a dust wrap which surrounds a peripheral portion of the wrap, and a groove is formed in a widthwise end of the dust wrap and a dust seal is fitted in the groove.

7. A scroll compressor according to claim 6, wherein a communication port for placing a scroll wrap portion and the suction port for sucking an operating gas, formed in said stationary scroll having the dust wrap, in communication with each other, is formed in the dust wrap.

8. A scroll compressor according to claim 1, wherein one of said first and second stationary scrolls having respective wraps has a dust wrap which surrounds a peripheral portion of the wrap, a gap formed between the dust wrap and the end plate of said orbiting scroll being capable of being measured through the cooling air inlet or the cooling air outlet.

9. A scroll compressor according to claim 1, wherein said orbiting scroll having wraps has dust wraps, each of which surrounds a peripheral portion of a corresponding one of the wraps, a widthwise gap formed between the dust wrap and each of said first and second stationary scrolls being capable of being measured through the cooling air inlet or the cooling air outlet.

10. A scroll compressor according to claim 1, wherein said at least one cooling path extends in a substantially straight line substantially perpendicular to a plane which connects an axis of said crank shaft and an axis of said auxiliary crank shaft.

* * * * *